US008803084B2

(12) United States Patent
Nishimura et al.

(10) Patent No.: US 8,803,084 B2
(45) Date of Patent: Aug. 12, 2014

(54) MASS SPECTROMETER AND MASS SPECTROMETRY

(71) Applicant: Hitachi High-Technologies Corporation, Tokyo (JP)

(72) Inventors: Kazushige Nishimura, Kokubunji (JP); Yuichiro Hashimoto, Tachikawa (JP); Masuyuki Sugiyama, Hino (JP); Masuyoshi Yamada, Ichikawa (JP); Hidetoshi Morokuma, Hitachinaka (JP)

(73) Assignee: Hitachi High-Technologies Corporation, Tokyo (JP)

( * ) Notice: Subject to any disclaimer, the term of this patent is extended or adjusted under 35 U.S.C. 154(b) by 0 days.

(21) Appl. No.: 13/726,294

(22) Filed: Dec. 24, 2012

(65) Prior Publication Data

US 2013/0161507 A1 Jun. 27, 2013

(30) Foreign Application Priority Data

Dec. 26, 2011 (JP) ..... 2011-282684

(51) Int. Cl.
*H01J 49/10* (2006.01)

(52) U.S. Cl.
USPC ..... 250/288; 250/281; 250/282; 250/423 P; 250/423 F

(58) Field of Classification Search
USPC ..... 250/423 R, 427, 423 P, 423 F, 424, 281, 250/282, 288
See application file for complete search history.

(56) References Cited

U.S. PATENT DOCUMENTS

| | | | | |
|---|---|---|---|---|
| 7,109,476 | B2 | 9/2006 | Hanold et al. | |
| 7,196,325 | B2 | 3/2007 | Syage | |
| 2005/0056776 | A1 * | 3/2005 | Willoughby et al. | 250/281 |
| 2011/0042560 | A1 | 2/2011 | Ouyang et al. | |
| 2011/0108726 | A1 * | 5/2011 | Hiraoka et al. | 250/282 |

FOREIGN PATENT DOCUMENTS

| | | |
|---|---|---|
| JP | 2011-117854 | 6/2011 |
| WO | WO 2011/089912 A1 | 7/2011 |

* cited by examiner

*Primary Examiner* — Nicole Ippolito
(74) *Attorney, Agent, or Firm* — Antonelli, Terry, Stout & Kraus, LLP.

(57) ABSTRACT

A mass spectrometer featured in including an ion source including a first electrode, a second electrode, and a dielectric unit having a sample introducing unit and a sample discharging unit and provided between the first electrode and the second electrode, a power source of ionizing a sample by a discharge generated between the first electrode and the second electrode by applying an alternating current voltage to either one of the first electrode and the second electrode, a mass spectrometry unit of analyzing an ion discharged from the sample discharging unit, and a light irradiating unit of irradiating an area of generating the discharge with light.

15 Claims, 11 Drawing Sheets

MASS SPECTROMETER AND MASS SPECTROMETRY

CLAIM OF PRIORITY

The present application claims priority from Japanese patent application JP 2011-282684 filed on Dec. 26, 2011, the content of which is hereby incorporated by reference into this application.

FIELD OF THE INVENTION

The present invention relates to a mass spectrometer and a mass spectrometry.

BACKGROUND OF THE INVENTION

In the field of mass spectrometry, there is not an ion source which can respond to all of requests. Therefore, various ionization methods such as corona discharge ionization and glow discharge ionization have been developed. References related to the present invention which uses dielectric barrier discharge or light are introduced.

U.S. Unexamined Patent Application Publication No. 2011/0042560 describes an ionization method using dielectric barrier discharge. According to the method, samples are ionized by irradiating a sample with a plasma generated by the dielectric barrier discharge. First, a discharge gas is introduced into a discharge area. The introduced discharge gas is converted into a plasma by the dielectric barrier discharge. The sample is irradiated with the generated plasma gas by an electric field or a pressure to ionize the sample. The dielectric barrier discharge used in this example generates a plasma in which a temperature of neutral molecules or ions is lower than a temperature of electrons. The plasma is referred to as a low temperature plasma and is featured in that samples are ionized with less fragmentation.

International Publication No. WO2011/089912 describes an ionization method using a dielectric barrier discharge under a reduced pressure. A pressure of an ion source is reduced, and therefore, it is not necessary to provide a capillary having a small conductance between the ion source and a mass spectrometry unit even in a case where a sample is prepared under an atmospheric pressure as in an atmospheric pressure chemical ionization method. Therefore, a loss of ions is reduced when ions are introduced from the ion source to the mass spectrometry unit, and a highly sensitive analysis can be carried out. Also, since the dielectric barrier discharge is used, a fragmentation of molecule ions is more restrained than in a glow discharge under a reduced pressure.

U.S. Pat. No. 7,109,476 describes a method of combining plural ionization methods to be used for an ion source of a mass spectrometer. The ionization methods are an atmospheric pressure photoionization method, an atmospheric pressure chemical ionization method, and an electrospray ionization method. According to the example, a method of continuously switching the ion sources or simultaneously operating the ion sources in analysis is described.

U.S. Pat. No. 7,196,325 describes a method of combining to use an ionization using a photoelectron and an ionization by glow discharge at an ion source of a mass spectrometer. The plural ion sources are operated separately or simultaneously in analysis. Particularly, according to the example, an emitter of a photoelectron is installed at a glow discharge area, and an method of a photoelectron induced electron ionization using the configuration is described. The method is that low energy photoelectrons are accelerated between electrodes for glow discharge and that samples are ionized by the electron.

Japanese Unexamined Patent Application Publication No. 2011-117854 describes a discharge ionization current detector mounted with an illumination as a current detector for a gas chromatograph. According to the example, an amount of ions generated by a dielectric barrier discharge by using a current detector is measured. The illumination installed at an ionization source unit plays a role of lowering a breakdown voltage of the dielectric barrier discharge by an irradiation of light. When the discharge is started, the discharge is continued by applying a discharge maintaining voltage which is lower than an ordinary breakdown voltage on electrodes, and a stable plasma is formed. Therefore, life of the illumination can be prolonged by switching off the illumination after starting the discharge.

SUMMARY OF THE INVENTION

According to the dielectric barrier discharge used in U.S. Unexamined Patent Application Publication No. 2011/0042560, a voltage of starting the discharge is higher than a voltage of maintaining the plasma. It is therefore difficult to start the discharge immediately after applying the breakdown voltage, and a time period after applying the breakdown voltage until the discharge is started is not constant. According to the background art, a voltage which is excessively higher than the voltage of maintaining the discharge needs to be supplied in order to resolve the problem. However, a molecule in the plasma is brought into fragmentation at the excessively high voltage. Therefore, a technology of starting the discharge at a low voltage is needed.

International Publication No. WO2011/089912 also has the same problem as U.S. Unexamined Patent Application Publication No. 2011/0042560. Furthermore, a new problem occurs in a case where a sample is introduced to a mass spectrometer discontinuously. In this case, the discharge is carried out discontinuously at each time of introducing the sample and the discharge gas. A time period after applying the discharge voltage until starting the discharge at each time of the discharge is therefore not constant, and an amount of ions detected is varied at each measurement.

According to U.S. Pat. Nos. 7,109,476 and 7,196,325, irradiation of light to the ion source and a detection of ions are carried out simultaneously. A charged particle detector that is used in the mass spectrometer detects light as a noise signal, and therefore, in a case of irradiating the ion source with light, a ratio of S/N of a detecting signal S of a sample ion to noise N is reduced. A detection sensitivity of the mass spectrometer is therefore reduced.

Densities of plasmas used in the atmospheric pressure photoionization method and the atmospheric pressure chemical ionization method described in U.S. Pat. No. 7,109,476 are smaller than that of a plasma generated by a dielectric barrier discharge. A sensitivity of the mass spectrometer is therefore lowered.

According to the glow discharge described in U.S. Pat. No. 7,196,325, the sample is easy to be brought into fragmentation in comparison with the dielectric barrier discharge. A mass spectrum is therefore complicated. Also, according to U.S. Pat. No. 7,196,325, a metal which becomes an electron emitter needs to be installed at a discharge area. A structure of an ion source unit is therefore complicated.

According to the current detector described in Japanese Unexamined Patent Application Publication No. 2011-117854, a description is given only of a case of measuring a current amount of an ion generated by the dielectric barrier discharge, and it is not described nor suggested that ions are separated in accordance with a mass-to-charge ratio.

The problems described above are resolved by a mass spectrometer that includes an ion source consisting of a first electrode, a second electrode, and a dielectric unit having a sample introducing unit and a sample discharging unit and provided between the first electrode and the second electrode, a power source of applying an alternating current voltage to either one of the first electrode and the second electrode, and ionizing a sample by a discharge generated between the first and the second electrodes, a mass spectrometry unit of analyzing an ion discharged from the sample discharging unit, and a light irradiating unit of irradiating an area at which the discharge is generated with light.

According to the present invention, a soft ionization can be carried out, which is difficult to bring a sample into fragmentation stably without lowering a sensitivity.

DETAILED DESCRIPTION OF THE PREFERRED EMBODIMENTS

First Embodiment

Figure 1:
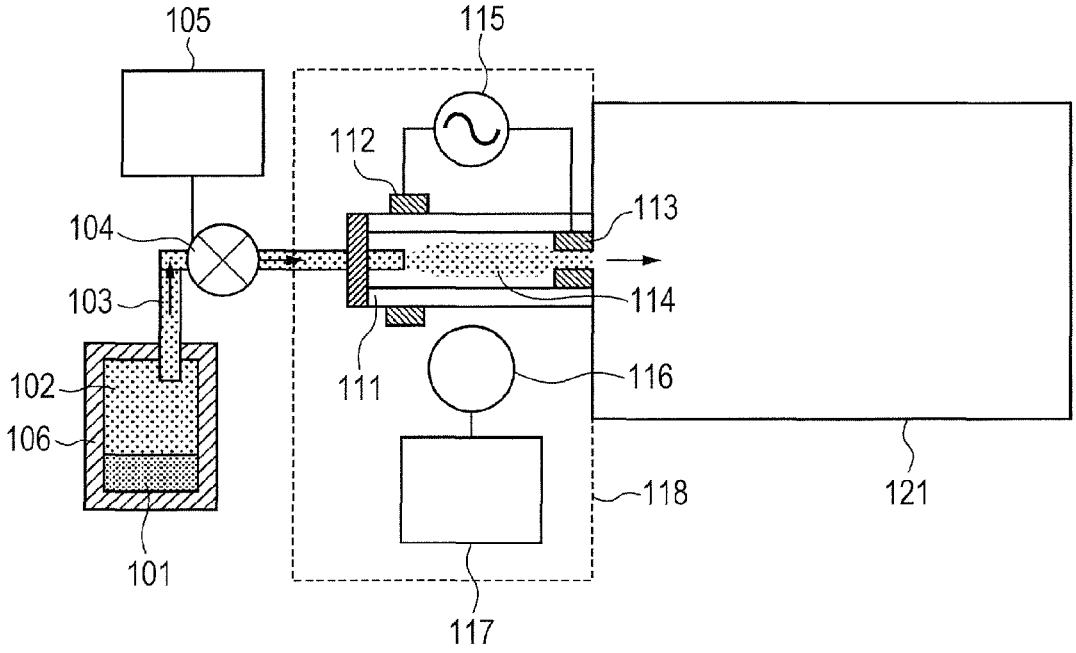
FIG. 1 shows a configuration example of a device according to the present invention.

FIG. 1 shows an embodiment of the present invention. A sample 101 in a sample vessel 106 may be in any state of gas, liquid, or solid. In a case where the sample 101 is a liquid or a solid, the sample 101 put into the sample vessel 106 is evaporated at an ordinary temperature, or by heating. A gas 102 including the sample is introduced to an ion source unit as shown by a flow 103 of the sample by a pressure difference produced by a vacuum pump installed at amass spectrometry and ion detecting unit 121 only when a valve 104 is opened. The valve 104 is controlled to open and close by using a valve opening/closing control mechanism 105. According to the example, the valve is opened during a time period equal to or more than 5 ms and equal to or less than 200 ms.

The sample reaching a discharge area 114 is ionized by a dielectric barrier discharge generated by using a light transmitting dielectric 111 such as Pyrex glass, an electrode 112 for discharge on a side of a sample introducing unit, an electrode 113 for discharge on a side of a mass spectrometry unit, and a low frequency alternating current power source 115 of 1 kHz through 300 kHz. In order to generate the dielectric barrier discharge, a dielectric between a plasma and at least one of the discharge electrodes is inserted. The dielectric is operated as a capacitor to prevent a rise of a plasma temperature by making a discharge current flow continuously. Therefore, the plasma generated by the dielectric barrier discharge is difficult to bring a molecule into fragmentation.

Figure 2:
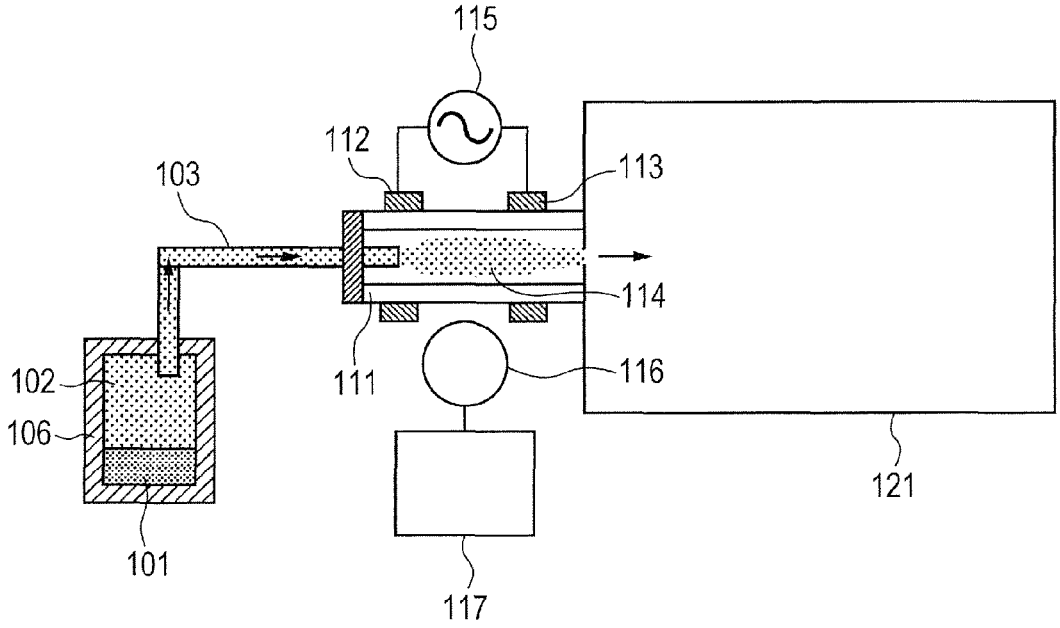
FIG. 2 shows a configuration example in a case where an electrode is arranged on an outer side of an ion source.

The discharge electrode 113 on a downstream side at which the sample flows as shown in FIG. 1 may be installed at an inner portion of an ion source. However, a surface of the discharge electrode 113 is not electrically charged by ions generated by the discharge, and therefore, ions are efficiently introduced to the mass spectrometry unit 121. Conversely, the both electrodes 112 and 113 may be arranged on an outer side of the ion source as shown in FIG. 2. In this case, a shape and an arrangement of the electrode can be changed from the outer side of the ion source, and therefore, a state of a plasma can be adjusted without disassembling the ion source.

An illumination 116 for irradiating an inner portion of the ion source with light, and a control mechanism 117 for controlling to switch on and switch off the illumination 116 on an outer side of the ion source are installed. A cover 118 prevents electric shock and shields light at a surrounding of the ion source, the illumination 116, and the control mechanism 117. A description will be given later of an effect of the illumination of light and shielding of light that is given to the device.

A voltage necessary for discharge is determined by a distance between electrodes, a composition of a flowing gas, a pressure of the discharge area 114 and the like. As a typical example, air including a sample is used as a discharge gas, and a discharge is carried under conditions of a pressure equal to or higher than 2 Torr and equal to or lower than 300 Torr, a distance between electrodes equal to or longer than 1 mm and equal to or shorter than 100 mm, and a voltage applied for discharge equal to or higher than 100 V and equal to or lower than 20 kV. A kind and a pressure of a discharge gas, a distance between the electrodes, and a voltage applied for discharge respectively contribute to the following effects.

When air is used as a discharge gas, the discharge gas can be obtained from the atmosphere. Therefore, a gas bomb or a mechanism for introducing a gas is not needed, and cost can be reduced. In a case where other gas of helium, argon, nitrogen or the like is used as a discharge gas, a kind of an ion or a radical generated in a plasma is changed, and therefore, an influence is effected on an ionization of a sample thereby. These gases may be used as necessary.

Figure 3:
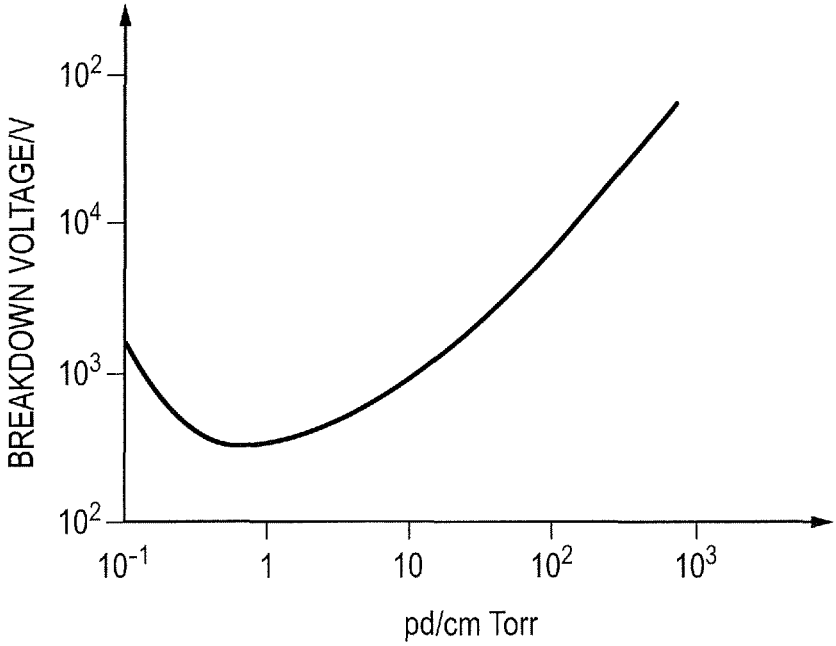
FIG. 3 shows an example of a relationship between a breakdown voltage of air and a product of a pressure P by a distance D between discharge electrodes (pd product)

A reduction of a pressure in an ion source leads to high sensitive analysis with less fragmentations. FIG. 3 shows a relationship between a breakdown voltage of air and a product of a pressure p by a distance d between discharge electrodes (pd product). A breakdown voltage is minimized at a vicinity of 0.5 cm·Torr, and thereafter, the larger the pd product, the more increased the breakdown voltage. For example, in a case where a discharge gas is air and a pressure is 10 Torr ($1.3\times10^3$ Pa), the breakdown voltage is about 1 kV with a distance between the electrodes of 1 cm, and about 4 kV with the distance between the electrodes of 5 cm. When a pressure in the discharge area 114 is higher than 300 Torr, a voltage necessary for starting discharge becomes high, and there is a possibility of effecting an influence on forming a plasma. Therefore, a stable plasma can be formed by making the pressure equal to or lower than 300 Torr. Also, a loss of ions by colliding with an inner wall of a tube can be restrained by increasing a conductance between the discharge area 114 and the mass spectrometry and ion detecting unit 121 by reducing the pressure in the discharge area 114. Therefore, an efficiency of introducing ions to the mass spectrometry unit 121 becomes high. A stable discharge can be carried out highly sensitively without bringing a molecule into fragmentation by reducing the pressure of the ion source from the reason described above. As a specific method of reducing a pressure of an ion source, a method of adjusting a conductance of a sample introducing port or an ion emitting port of an ion source, or hermetically closing a sample vessel is conceivable.

When the distance between the electrodes is changed, a time period during which a gas passes in a plasma is changed. Thereby, a kind or an amount of an ion or a radical generated is changed. When the distance between the electrodes is excessively increased, the device is large-sized, or an expense taken for a power source is increased by increasing a voltage necessary for a discharge.

In a case where a sample directly passes through a plasma as in this example, a voltage applied for a discharge effects an influence on a mass spectrometry result. For example, when the voltage is low, the fragmentation of the sample is inconsiderable, and a soft ionization can be carried out. this case, kinds of ions to be detected are few, and therefore, an analysis on a spectrometric result is made to be easy.

The sample ion generated at the discharge area 114 is introduced into the mass spectrometry unit 121 by a pressure difference produced by a vacuum pump installed at the mass spectrometry and ion detecting unit 121. In the mass spectrometry unit 121, ions are separated in accordance with mass-to-charge ratios. An ion trap, a quadrupole mass filter, a time-of-flight mass spectrometer, etc. are used as a device of separating mass. In this example, a linear ion trap is used.

Separated ions are detected by using a detector of an electron multiplier or a multichannel plate.

Figure 4:
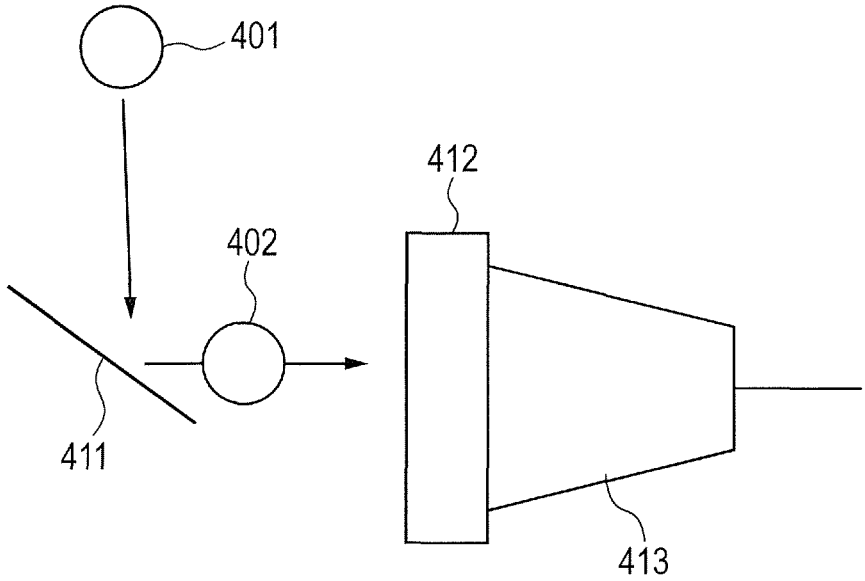
FIG. 4 shows an example of an ion detector system.

FIG. 4 shows a configuration of an ion detector system used in the embodiment of FIG. 1 as an example of an ion detector system. An ion 401 having a certain mass-to-charge ratio collides with a conversion dynode 411 by being exerted with a force of an electric field. An electron 402 is emitted from the conversion dynode 411 and is introduced to a scintillator 412 by the same electric field. The scintillator 412 emits light when the electron 402 is incident thereon. The light is converted into a photoelectron, and a voltage is amplified to a measurable height by using a photomultiplier tube 413. An output signal of the detector is proportional to an amount of incident ions, and therefore, mass spectra can be obtained by measuring amounts of ions having respective mass-to-charge ratios.

Figure 5:
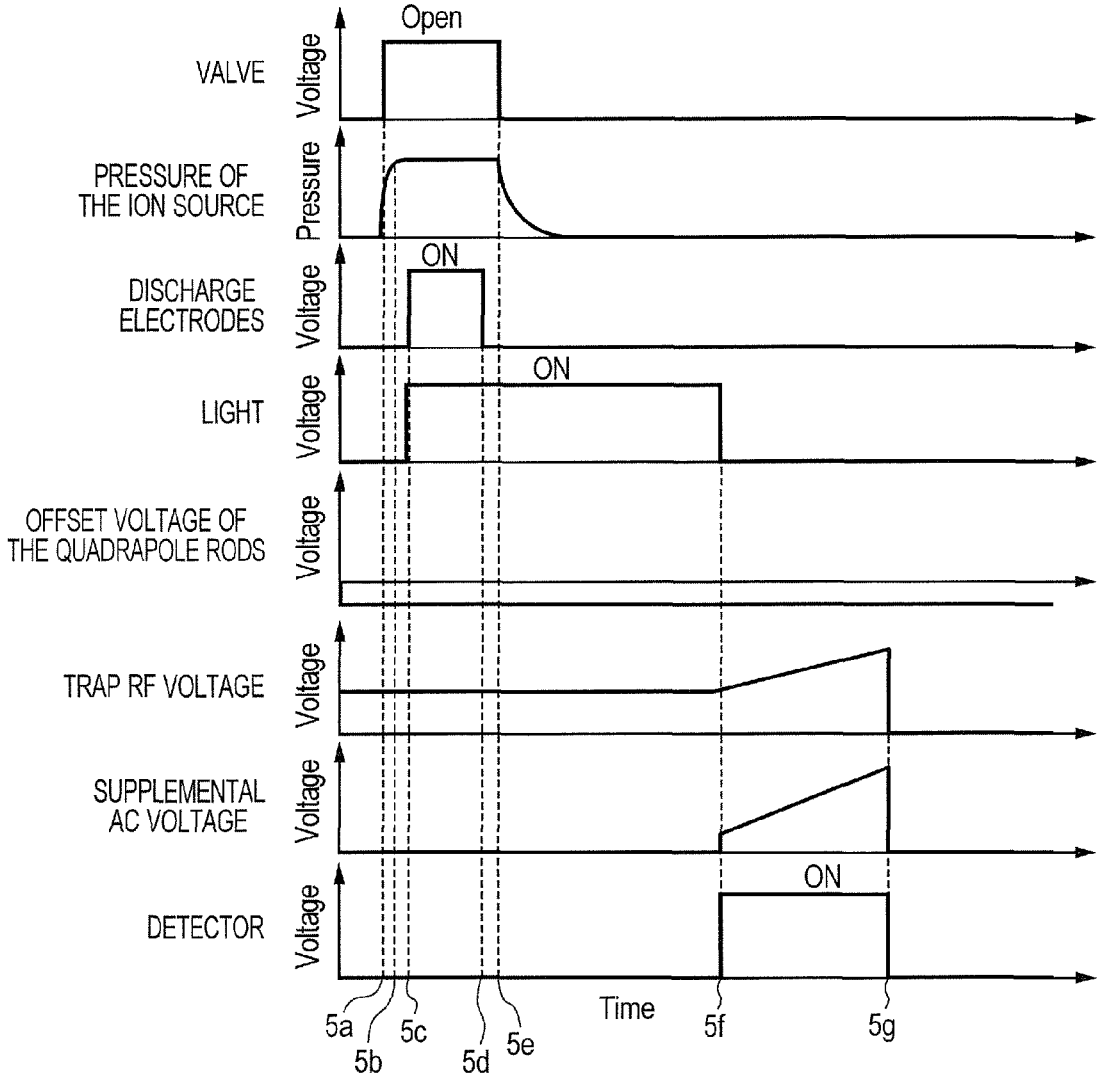
FIG. 5 shows an example of a measurement sequence in a case where a sample is discontinuously introduced.

Next, a description will be given of a measurement sequence of an ion. FIG. 5 shows a measurement sequence in the case of discontinuous introduction. The ordinate designates respective voltages and the pressure of an ion source, and the abscissa designates time. First, a voltage is supplied to the valve at timing 5*a* of the diagram, and the valve is opened. Further, the gas 102 including the sample flows into the discharge area 114, and the pressure in the ion source is increased. Next, the pressure in the ion source is saturated at timing 5*b;* thereafter, a voltage is applied to the discharge electrode at timing 5*c*. In this example, a voltage is supplied to an illumination simultaneously with application of the voltage, and the illumination is switched on. The discharge is continued until the sample is sufficiently ionized. When the voltage for discharge is cut off at timing 5*d*, a plasma is extinguished. Further, when the valve is closed at timing 5*e*, the pressure of the ion source is reduced by a pump installed at the mass spectrometry unit 121.

In a case of introducing the sample discontinuously, the pressure of the ion source is changed over time, and therefore, also a state of the generated plasma is changed over time. Therefore, it is necessary to adjust a valve opening time period and a discharge voltage applying time period to be able to ionize the sample efficiently. A state of the plasma can be controlled by adjusting timings of a voltage supplied to the valve and a voltage applied for a discharge. In a case where the discharge needs to be carried out discontinuously in this way, particularly in the dielectric barrier discharge having the high breakdown voltage, a time period until a discharge is started after applying the discharge voltage does not stay constant, and an amount of ions generated at each discharge is liable to be varied.

FIG. 5 also shows a control sequence in a case where a linear ion trap is used in the mass spectrometry unit 121. In the linear ion trap, an ion is trapped by adjusting an offset voltage of quadrupole rods and a trap RF voltage. After trapping the ion, a supplemental RF voltage is applied at timing 5*f*, and the ion having a selected mass-to-charge ratio is emitted. In the example of the measurement sequence, the illumination is switched off simultaneously therewith, and the voltage is applied to the detector. An emitted ion is detected by the detector. When the ion is detected, an operating voltage of the detector needs to be applied. After detecting the ion, the trap RF voltage is cut off at timing 5*g*, and all of ions in the ion trap are evacuated.

Next, an explanation will be given of timings of flickering of the illumination. FIG. 5 shows an example of an illumination flickering sequence. Important timings are the timing 5*c* of starting discharge and timing 5*f* of starting the operation of the detector. The illumination is switched on at least at timing 5*c* of starting to apply the discharge voltage. This is because the discharge is induced by generating an initial electron in the ion source by irradiating the ion source with light. Also, the illumination is switched off at timing Sf of starting to operate the detector. At this occasion, a quantity of light to be irradiated to the ion source may only be reduced without switching off the illumination. Thereby, a reduction in a sensitivity of the device by detecting light when the ion is detected can be prevented. A detailed description will later be given of an effect of inducing the discharge and an effect of reducing a sensitivity of the device by the light.

Figure 6:
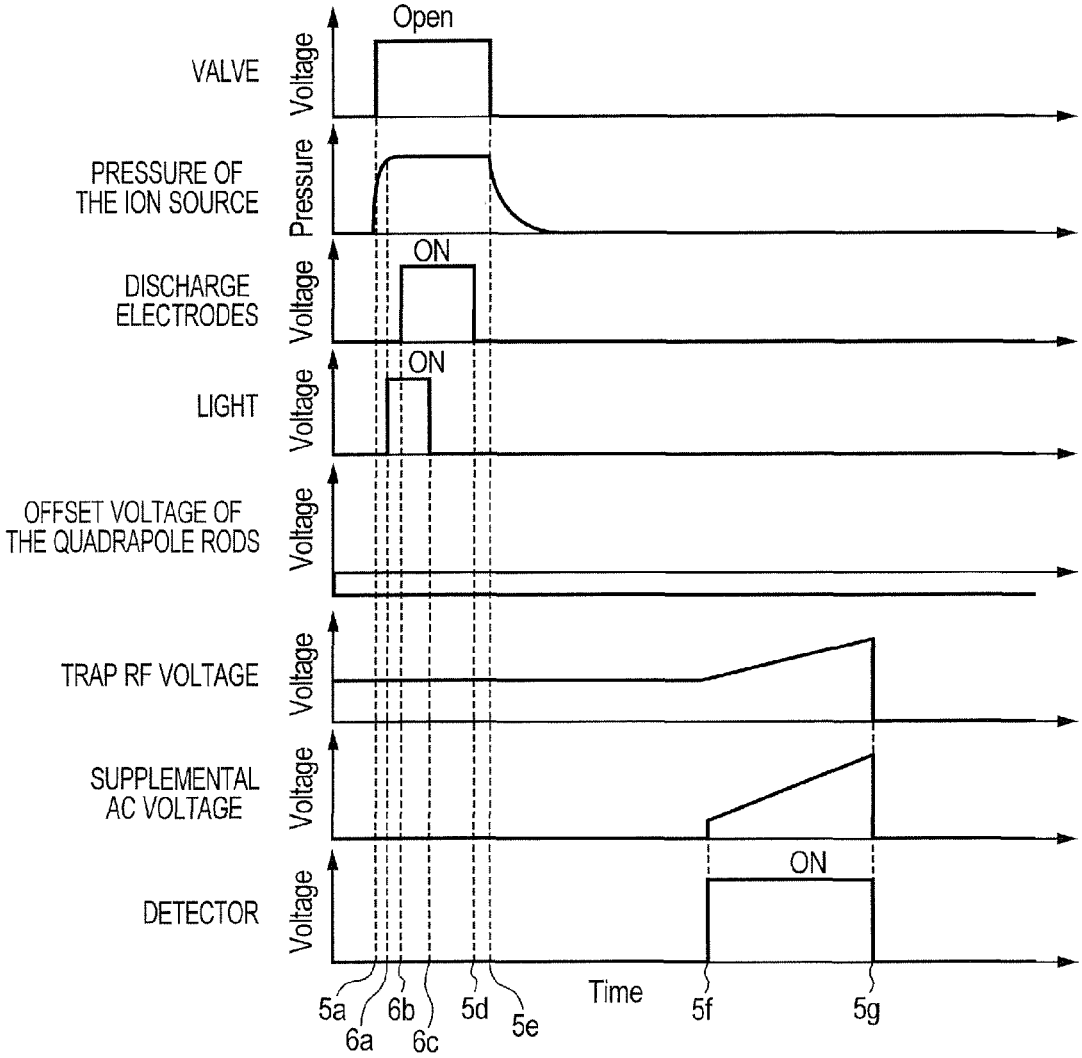
FIG. 6 shows an example of a measurement sequence when a time period of switching on an illumination is shortened.

FIG. 6 shows other example of the illumination flickering sequence. According to the example, the illumination is switched on at timing 6*a* prior to a timing 5*b* of starting to apply the discharge voltage. Thereby, a time period until starting the discharge after applying the discharge voltage is shortened. Also, light contributes to the discharge only when the discharge is started, and therefore, the illumination may be switched off at timing 5*c* of starting the discharge. Here, the illumination may not be switched off completely but the illuminance may only be reduced as described above. In this case, the time of switching on the illumination is shorter than that in the case of FIG. 5, and a power consumption can be restrained.

Figure 7:
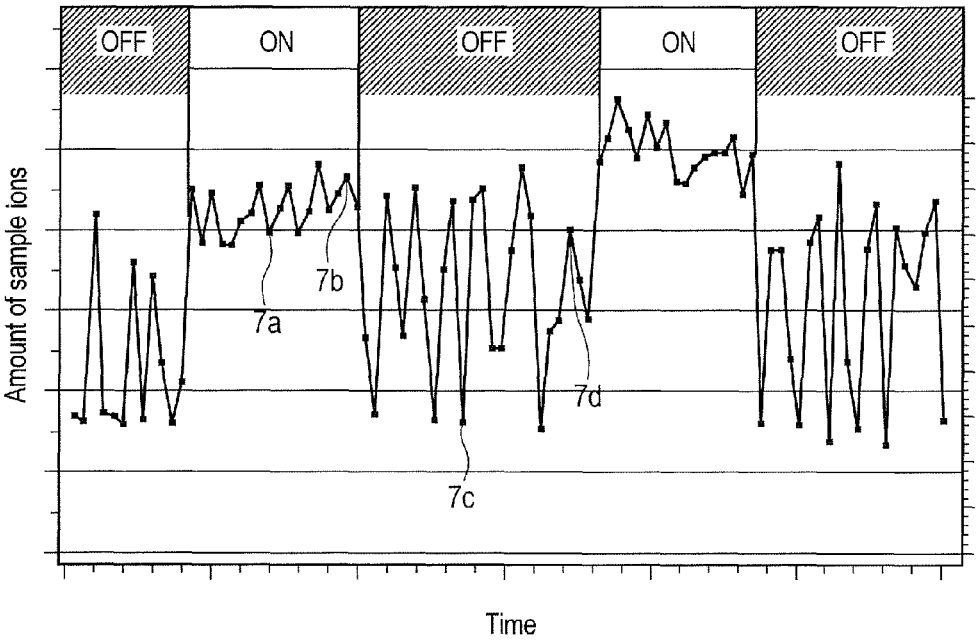
FIG. 7 shows an influence of an illumination of light effected on an ion amount to be measured.

Successively, a description will be given of an influence of light effected on a mass spectrometer. According to the present invention, the time period until starting discharge after applying the discharge voltage is made to be constant by irradiating the inner portion of the ion source with light, and an amount of ions generated by the ion source is stabilized. FIG. 7 shows an influence of the irradiation of light effected on the amount of the ion to be measured. The ordinate designates a detected amount of a sample ion, and the abscissa designates time. When the illumination is switched off, an amount of the sample ion to be detected is considerably increased or reduced as indicated by 7*c* and 7*d* in the drawing. Particularly, at 7*c*, the sample ion is not detected, and a signal intensity is small. In contrast thereto, the detected amount of the sample ion is hardly varied as indicated by 7*a* and 7*b* in the drawing when the illumination is switched on.

An explanation will be given of a mechanism of contributing to stabilize the detected ion amount by irradiation of light. A voltage which is applied in the discharge may be lowered to a voltage which can maintain discharge such that the sample is not brought into fragmentation. However, in the dielectric barrier discharge, the voltage of starting the discharge is higher than the voltage of maintaining the discharge. Therefore, a time period until the discharge is started after applying the discharge voltage is varied. In this example, the time period of maintaining the plasma by the discharge is to a degree the same as that of a time period of opening the valve, that is, 5 ms through 200 ms. When the time period of applying the discharge voltage is short in this way, there is a case where the discharge does not occur. At 7*c* in the drawing, it seems that the sample ion is not detected since the discharge does not occur at the ion source. However, when the illumination is switched on, the sample ion is necessarily detected as in 7*a* or 7*b* in the drawing, and the discharge stably occurs. It is known therefrom that when the ion source is irradiated with light, the discharge is induced.

An explanation can be given as follows of the effect of inducing the dielectric barrier discharge by light. When the inner portion of the ion source is irradiated with light, an initial electron is generated at the discharge area. The initial electron induces the discharge, and the breakdown voltage of the barrier discharge is lowered. Therefore, the discharge is made to be easy to be started, and the amount of ions generated by the ion source is stabilized. When the discharge is started, the light hardly contributes to the discharge, and the plasma is maintained by the dielectric barrier discharge.

As an illumination, a light emitting diode (LED) may be used from view points of a size, a power consumption, and a price. A wavelength of light used may fall in a region from visible light to ultraviolet ray. An effect of inducing the discharge is confirmed at least with regard to blue color (470 nm), white color (≥460 nm), and ultraviolet ray (375 nm). A discharge inducing effect is high in a case of light of a short wavelength having a high energy, and it is preferable to use ultraviolet ray. Also, the larger the amount of light to be irradiated, the higher the effect, and the nearer the illumination to the discharge area 103 of FIG. 1, the better so far as it is permitted to make the illumination near to the discharge area 103. In a case of using LED for the illumination, since a directivity of the light source is high, it is effective to direct the light source to the discharge area 103. Naturally, the effect of the present invention is achieved even when an illumination other than LED is used.

In a case of installing the illumination on the outer side of the ion source as in this example, it is preferable to select a material of a dielectric having high light transmittance performance. Quartz glass excellently transmits light, and therefore, an intensity of light irradiating the ion source is intensified.

Figure 8:
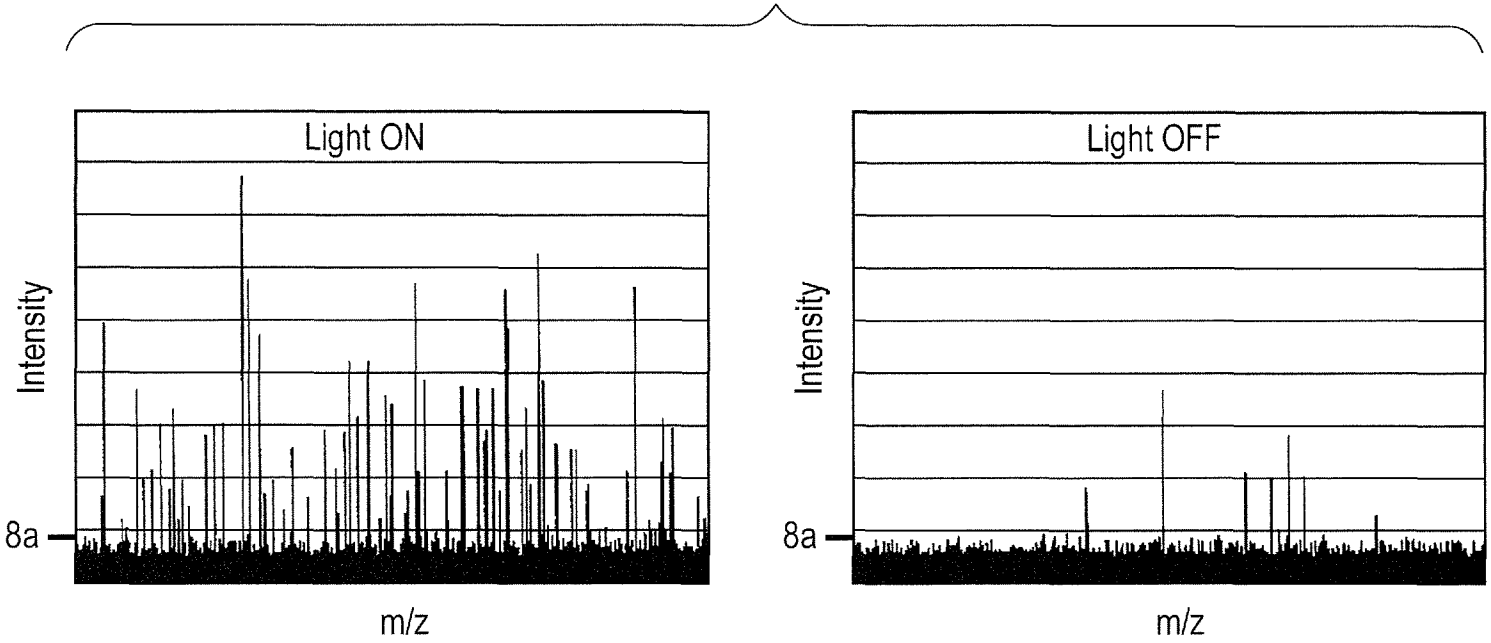
FIG. 8 shows an influence of light effected on a mass spectrum.

FIG. 8 shows an influence of light effected on a mass spectrum. Output signals of a detector in a case where light of an illumination of a room is incident on a detector and a case where the light of the illumination of the room is shielded from the detector when the scintillator is operated are compared. The ordinate in the drawing designates a voltage of an output signal of the detector. All of signals higher than 8*a* in the diagram are noise signals. In a case of light incident thereon (left diagram, Light ON), in comparison with a case of shielding light (right diagram, Light OFF), a number of larger noise signals are detected. It is known from the experimental result that light is detected as the noise signal. Detectors used in mass spectrometry starting from the scintillator used in this example detect light as a noise. Thereby, a ratio of S/N of a detecting signal S of the sample ion to a noise N is reduced, and a sensitivity of the mass spectrometer is lowered. Therefore, an effect of improving a sensitivity is achieved by installing an opaque cover which shields surrounding light so as not to detect light, and a control mechanism of switching off the illumination or reducing the illuminance when the ion is detected.

Second Embodiment

Figure 9:
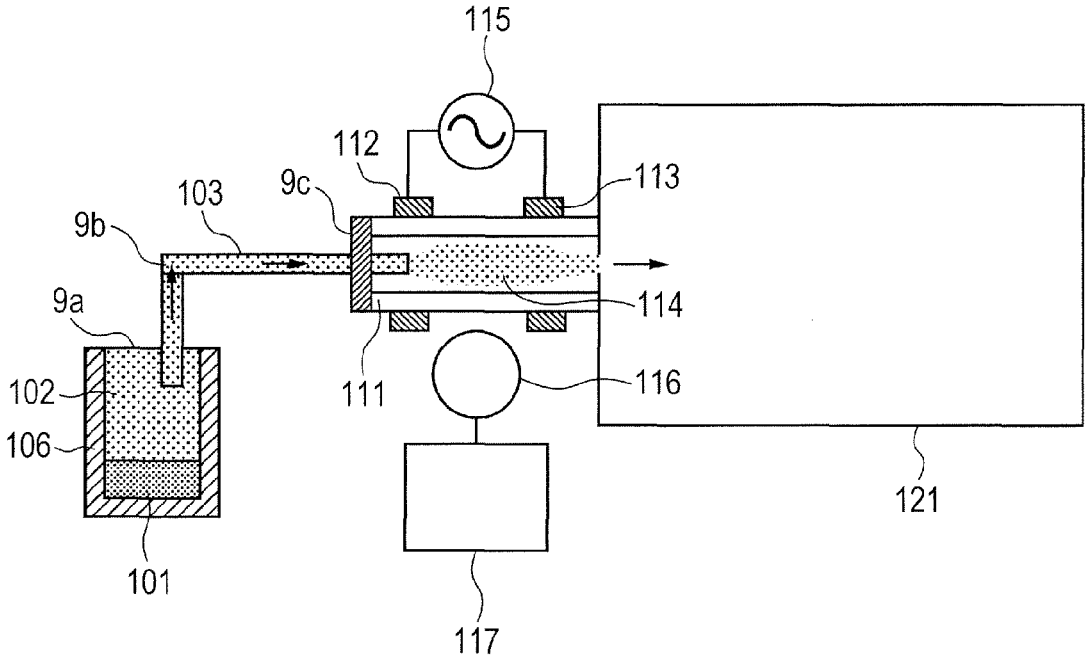
FIG. 9 shows a configuration example in a case where a sample is continuously introduced.

FIG. 9 shows an embodiment in a case of continuously introducing a sample. Although a basic configuration of Second Embodiment is the same as that of First Embodiment (FIG. 1), there are not the cover, the valve and the valve opening/closing control mechanism. The sample 101 is introduced to the ion source unit along with the discharge gas by the pressure difference produced by the vacuum pump installed at the mass spectrometry and ion detecting unit 121. According to the example, air is continuously introduced as a discharge gas by opening the sample vessel to 106 to the atmosphere. Therefore, a mechanism of supplying the discharge gas of a gas bomb or the like is not needed. However, an ion or a radial generated by a plasma differs by a discharge gas, and therefore, a mechanism of introducing a gas of helium, argon, nitrogen or the like as a discharge gas may be installed as necessary. 9*a*, 9*b*, or 9*c* in the drawing is conceivable as a location of installing a gas introducing mechanism. In a case of installing the gas introducing mechanism at the sample vessel 106 as in 9*a*, the sample vessel may hermetically be closed. Thereby, a gas in the atmosphere can be prevented from being mixed to the sample vessel. In a case of installing the gas introducing mechanism at a pipe of the sample introducing portion as in 9*b*, the gas is introduced by branching the pipe. In this case, the sample is introduced to the discharge area 114 while being mixed with the introduced gas. Therefore, a way of mixing is changed depending on a position of the branch point of the pipe, or flow speeds of the sample and the gas. Also, the gas can directly be introduced to the ion source as in 9*c*. The ways of mixing may properly be used as necessary.

In a case of the continuous introduction, the gas is continuously introduced to the mass spectrometry unit 121. Therefore, a degree of vacuum of the mass spectrometry unit 121 is lowered, and there is brought about a loss of ions by a discharge of the detector which is applied with a high voltage or collision of an ion and a gas. Therefore, a configuration of maintaining vacuum of the mass spectrometry unit 121 is constructed. A degree of vacuum of the mass spectrometry unit 121 is determined by an amount of the gas flowing into the mass spectrometry unit 121 and an amount of the gas discharged by the vacuum pump. The degree of vacuum of the mass spectrometry unit 121 can be lowered by reducing an amount of the gas per unit time flowing into the mass spectrometry unit 121 by reducing a conductance of an opening portion for introducing the sample, or an opening portion of discharging ions of the ion source by using a capillary or the like. However, when the flowing amount of the gas is reduced, a detection sensitivity of the device is lowered. Also, a vacuum pump having a large discharge amount is used since the amount of the gas discharged from the mass spectrometry unit 121 is increased. Therefore, a total of the device is large-sized by enlarging the vacuum pump. However, in a case of the continuous introduction, different from the case of discontinuous introduction, the valve and the control mechanism of operating to open and close the valve at the sample introducing unit are not needed, which leads to an effect of capable of simplifying the device configuration of the sample introducing unit.

Figure 10:
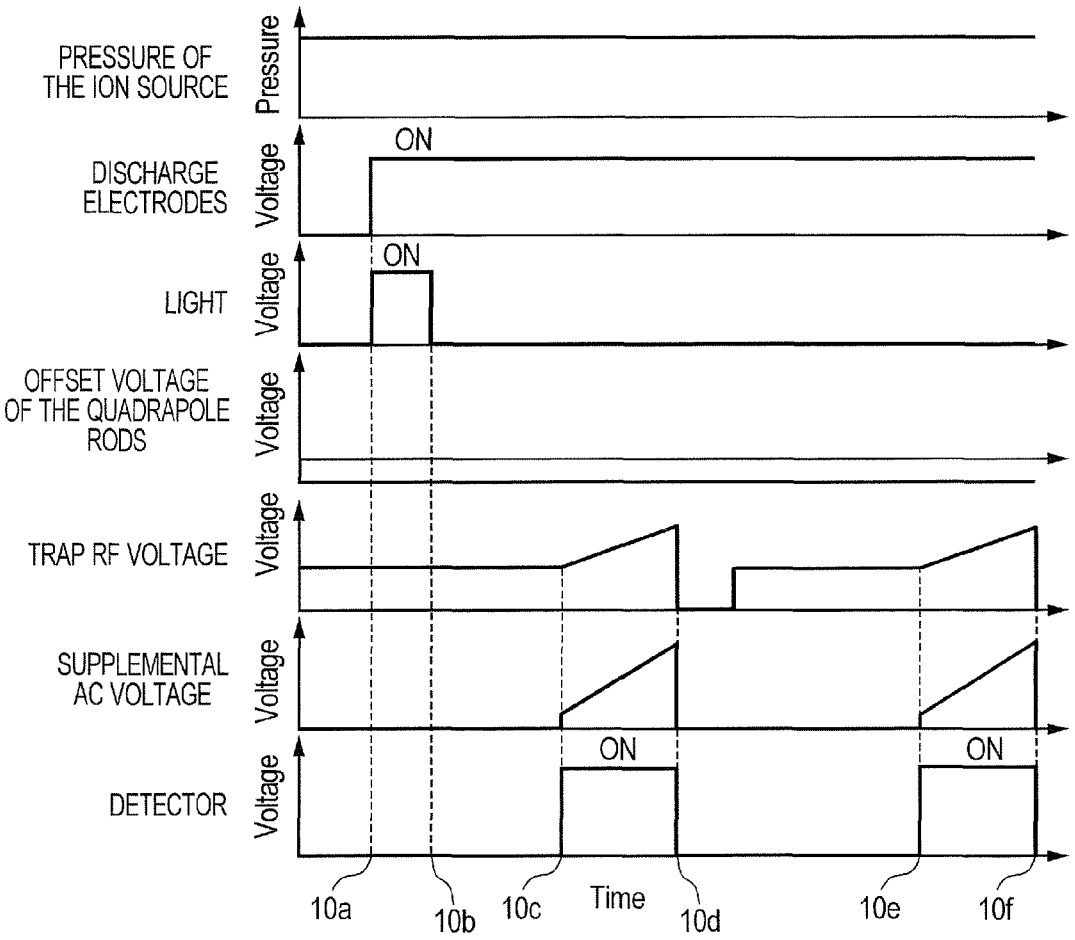
FIG. 10 shows an example of a measurement sequence in a case where a sample is continuously introduced.

FIG. 10 shows a measurement sequence in a case of continuously introducing the sample. In this example, an ion trap is used as the mass spectrometer. The ordinate designates the respective voltages and the pressure of the ion source, and the abscissa designates time. In a case of continuously introducing the sample and the discharge gas, the pressure of the ion source stays constant. Thereby, a condition of the discharge remains unchanged, and the discharge can continuously be carried out. Therefore, the amount of ions generated at the ion source is hardly varied.

In a case of continuously introduction, the illumination may be switched on only at the first one time at which the voltage is applied on the discharge electrode as indicated by 10*a* in the drawing. This is because when the discharge is induced once by light, thereafter, the discharge is continued stably by the alternating current voltage. Therefore, the illumination may be switched off after starting the discharge as indicated by 10*b*. In this case, in comparison with the case of discontinuously introducing the sample, a time period of switching on the illumination is short, and the power consumption necessary for the illumination can be reduced. The measurement sequence can be simplified by continuing to switch off the illumination after starting the discharge. The illumination may be switched off during a time period from 10*c* to 10*d*, and during a time period from 10*e* to 10*f* when the ions are detected in order to prevent a reduction in the detection sensitivity by detecting light. The illumination may not completely be switched off but the illuminance may be lowered as described in First Embodiment.

Third Embodiment

Figure 11:
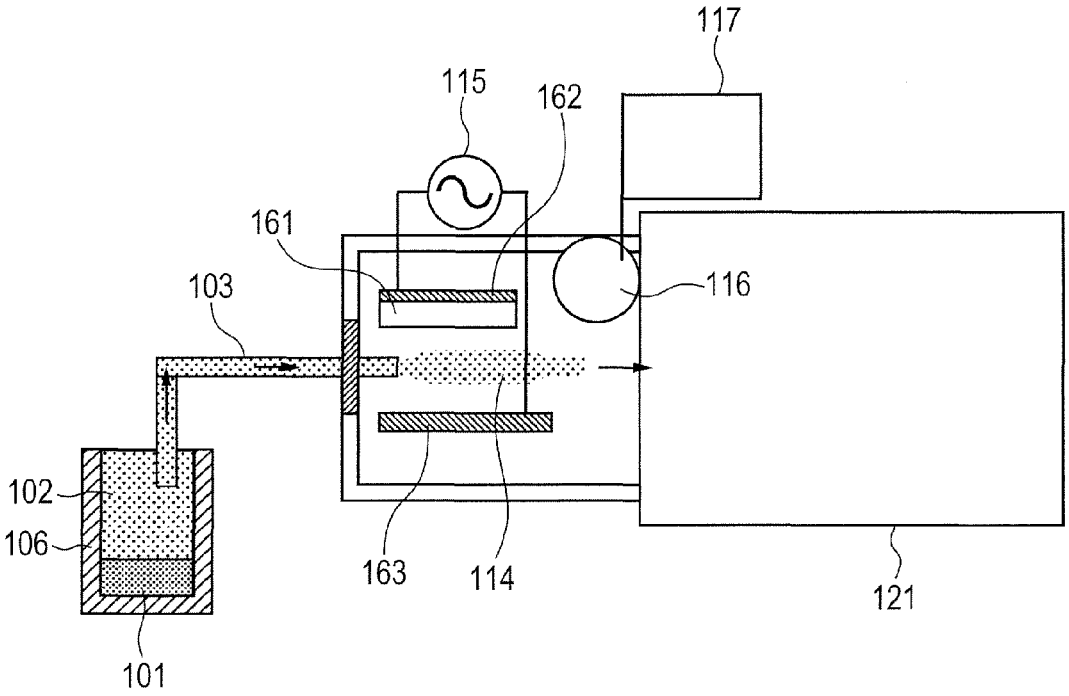
FIG. 11 shows an example in a case where an illumination is arranged in an ion source.

FIG. 11 shows an example of installing a light source at an inner portion of an ion source. A configuration of an ion source unit differs from that of First Embodiment (FIG. 1). At the ion source, a dielectric barrier discharge is generated at the discharge area 114 by using an electrode 162 for discharge covered by a dielectric 161, a discharge electrode 163, and the alternating current power source 115. Even in a case where only one of the electrodes on the side of the discharge area is covered with the dielectric 161 as in FIG. 11, a low temperature plasma in which fragmentation of the sample is inconsiderable can be generated. An expense necessary for the dielectric can be reduced by reducing an amount of using the dielectric.

Although the illumination is installed at the inner portion of the ion source in this example, a dielectric which does not transmit light can be used since it is not necessary to transmit light therethrough. A quantity of light can be increased without chancing the power consumption of the illumination since an intensity of light emitted from the light source is not attenuated.

Fourth Embodiment

Figure 12:
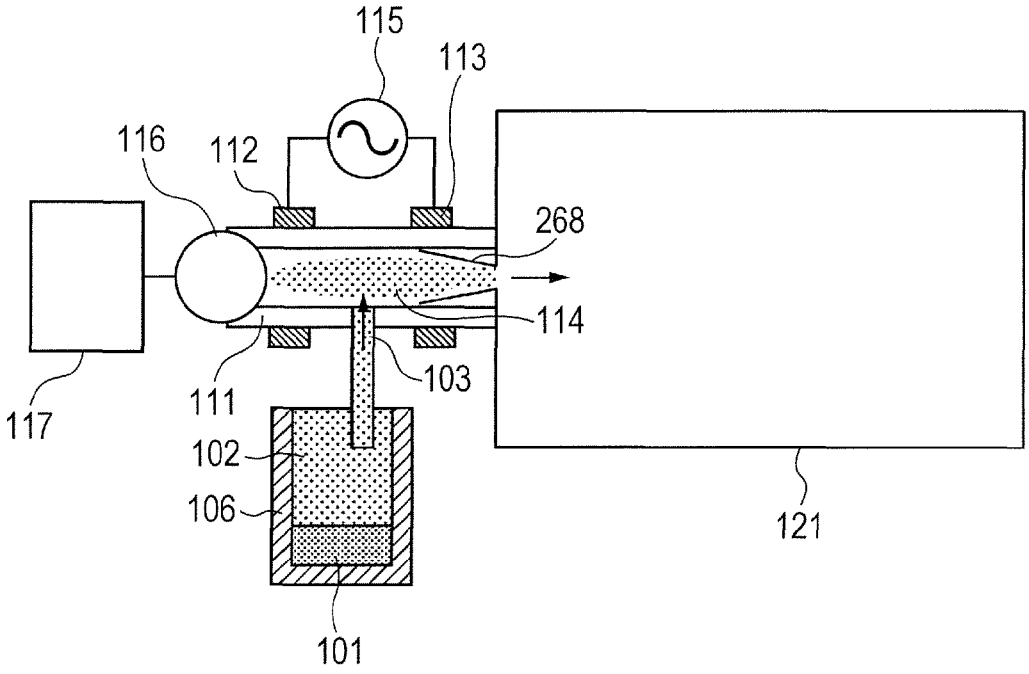
FIG. 12 shows an example of a case where a reflector is provided at an inner portion of an ion source.

FIG. 12 shows an example of installing a reflector at an inner portion of an ion source. The sample 101 which is put into the sample vessel 106 is evaporated and introduced to the discharge area 114 by the pressure difference produced by the vacuum pump installed at the mass spectrometry and ion detecting unit 121. The gas including the introduced sample is ionized by the dielectric barrier discharge generated by using the dielectric 111 which transmits light, the electrodes 112 and 113 for discharge, and the alternating current power source 115.

At the ion source, light is irradiated by the illumination 116 and the mechanism 117 of controlling to switch on and switch off the illumination 116. According to the example, a reflector 268 such as a mirror of reflecting light at inside of the ion source is installed. Although a structure of the inner portion of the ion source is complicated by installing the reflector 268, the quantity of light irradiating into the ion source is increased. Therefore, the effect of inducing discharge by light can be improved without increasing the power consumption necessary for the illumination.

What is claimed is:

1. A mass spectrometer comprising:

an ion source including a first electrode, a second electrode, and an insulator, wherein the insulator is provided between the first electrode and the second electrode, and has a sample gas inlet and outlet;

a power source configured to apply an alternating current voltage to either one of the first electrode and the second electrode, and to generate a dielectric barrier discharge between the first electrode and the second electrode;

a mass spectrometry unit configured to analyze sample ions produced by the dielectric barrier discharge and extracted from the outlet of the ion source; and a light irradiating unit configured to irradiate light on an area where the discharge is generated.

2. The mass spectrometer according to claim 1, further comprising:

an irradiation controlling unit configured to control an illuminance of the light irradiated by the light irradiating unit, wherein the illumination controlling unit is configured to lower the illuminance of the light irradiated by the light irradiating unit when the mass spectrometer analyzes the ion.

3. The mass spectrometer according to claim 2, wherein the irradiation controlling unit is configured to switch off the light irradiating unit when the mass spectrometry unit analyzes the ion.

4. The mass spectrometer according to claim 2, wherein the irradiation controlling unit is configured to switch on the light irradiating unit during a portion of a time period of applying the alternating current voltage, or a total of a time period of applying the alternating current voltage.

5. The mass spectrometer according to claim 2, wherein the irradiation controlling unit is configured to switch on the light irradiating unit before applying the alternating current voltage, and is configured to lower the illuminance of the light irradiated by the light irradiating unit before finishing a state of applying the alternating current voltage.

6. The mass spectrometer according to claim 4, wherein the sample is continuously introduced at the sample introducing unit.

7. The mass spectrometer according to claim 1, further comprising:

a valve; and a valve controlling unit configured to control a time period of opening the valve, and a time period of closing the valve.

8. The mass spectrometer according to claim 1, wherein the light irradiating unit is installed at an inner portion of the ion source.

9. The mass spectrometer according to claim 1, wherein a reflector is included at an inner portion of the ion source.

10. The mass spectrometer according to claim 1, wherein the discharge is carried out at a Torr value within a range of Torr values from 2 to 300, inclusive of 2 and 300.

11. A spectrometry method, comprising:

a sample introducing step, of introducing a sample to a dielectric unit, the dielectric unit having a sample introducing unit and a sample discharging unit, and the dielectric unit being provided between a first electrode and a second electrode;

a voltage applying step, of applying an alternating current voltage to either one of the first electrode and the second electrode, by using a power source;

an ionizing step, of ionizing the sample in the dielectric unit, while using an irradiation controlling unit to irradiate light to an area between the first electrode and the second electrode; and an analyzing step, of analyzing the ionized sample after a dielectric barrier discharge in the sample discharging unit of the dielectric unit.

12. The mass spectrometry according to claim 11, wherein in the ionizing step, an illuminance of the irradiated light by the irradiation controlling unit is lowered before starting the analyzing step.

13. The mass spectrometry according to claim 12, wherein in the analyzing step, the light is switched off by the irradiation controlling unit before starting the analyzing step.

14. The mass spectrometry according to claim 12, wherein in the voltage applying step, the irradiation controlling unit switches on the light irradiating unit during a portion of a time period, or a total of a time period, of applying the alternating current voltage.

15. The mass spectrometry according to claim 12, wherein in the ionizing step, the irradiation controlling unit switches on the light irradiating unit before applying the alternating current voltage at the voltage applying step, and lowers the illuminance of the light irradiated by the light irradiating unit before finishing a state of applying the alternating current voltage.

* * * * *